US009592513B2

(12) United States Patent
Hämäläinen

(10) Patent No.: US 9,592,513 B2
(45) Date of Patent: Mar. 14, 2017

(54) CRUSHER

(71) Applicant: BMH TECHNOLOGY OY, Rauma (FI)

(72) Inventor: Mikko Hämäläinen, Rauma (FI)

(73) Assignee: BMH TECHNOLOGY OY, Rauma (FI)

( * ) Notice: Subject to any disclaimer, the term of this patent is extended or adjusted under 35 U.S.C. 154(b) by 316 days.

(21) Appl. No.: 14/374,326

(22) PCT Filed: Jan. 24, 2013

(86) PCT No.: PCT/FI2013/050075
§ 371 (c)(1),
(2) Date: Jul. 24, 2014

(87) PCT Pub. No.: WO2013/113989
PCT Pub. Date: Aug. 8, 2013

(65) Prior Publication Data

US 2015/0001325 A1 Jan. 1, 2015

(30) Foreign Application Priority Data

Jan. 30, 2012 (FI) ..... 20125091

(51) Int. Cl.
*B02C 13/31* (2006.01)
*B02C 13/284* (2006.01)
(Continued)

(52) U.S. Cl.
CPC ..... *B02C 13/31* (2013.01); *B02C 13/09* (2013.01); *B02C 13/284* (2013.01); *B02C 18/14* (2013.01);
(Continued)

(58) Field of Classification Search
USPC ..... 241/243, 73, 289, 290
See application file for complete search history.

(56) References Cited

U.S. PATENT DOCUMENTS 5,971,305 A * 10/1999 Davenport ..... B02C 18/0084 241/197

FOREIGN PATENT DOCUMENTS

| | | |
|---|---|---|
| DE | 195 14 951 A1 | 10/1996 |
| DE | 299 10 772 UI | 11/1999 |
| EP | 2 374 544 A2 | 10/2011 |

OTHER PUBLICATIONS

Supplementary European Search Report dated Oct. 20, 2015 for Application No. EP 13743532.7.

(Continued)

*Primary Examiner* — Mark Rosebaum
(74) *Attorney, Agent, or Firm* — Ladas & Parry LLP

(57) ABSTRACT

The invention relates to a crusher for crushing solid material, the crusher comprising a frame; at least one crusher rotor arranged rotatably to the frame and having crusher blades secured to the circumference thereof; a yielding counterblade structure arranged for cooperation with the crusher blades of the rotor for concurrently crushing and cutting said material and for yielding when encountering non-crushable material and when overloaded; and a yielding and downwardly openable set of screens below the crusher rotor, whereby the counterblade structure is linked to the frame of the set of screens and made turnable towards it with respect for the pivoting shaft in a yield situation; and the set of screens is linked to the crusher frame on the opposite side of the crusher rotor with respect to the counterblade structure and its pivoting shaft and made downwardly collapsible about the pivoting shaft of the set of screens.

12 Claims, 1 Drawing Sheet

Figure 3:
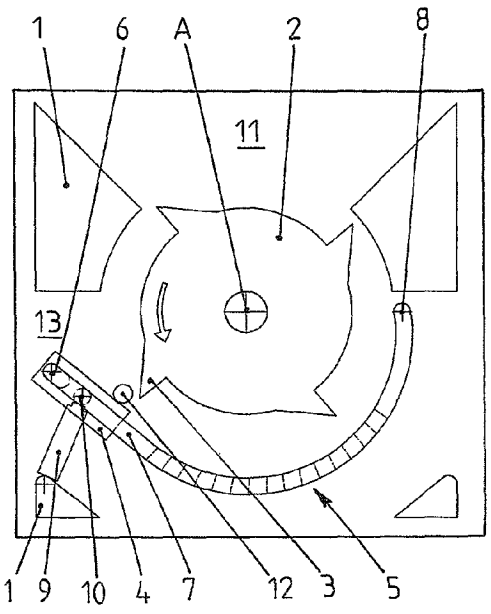

(51) Int. Cl.

| | |
|---|---|
| ***B02C 13/09*** | (2006.01) |
| ***B02C 18/14*** | (2006.01) |
| *B02C 18/16* | (2006.01) |
| *B02C 18/18* | (2006.01) |
| *B02C 23/16* | (2006.01) |

(52) U.S. Cl.
CPC .. *B02C 2018/164* (2013.01); *B02C 2018/188* (2013.01); *B02C 2023/165* (2013.01)

(56) References Cited

OTHER PUBLICATIONS

Espacenet English abstract of DE 195 14 951 A1.
Espacenet English abstract of EP 2 374 544 A2.

* cited by examiner

CRUSHER

RELATED APPLICATION INFORMATION

This application is a 371 of International Application PCT/FI2013/050075 filed 24 Jan. 2013 entitled "CRUSHER", which was published in the English language on 8 Aug. 2013, with International Publication Number WO 2013/113989 A1 and which claims priority from Finish Patent Application Number 20125091 filed 30 Jan. 2012, the content of which is incorporated herein by reference.

BACKGROUND OF THE INVENTION

The invention relates to a crusher for crushing solid material, the crusher comprising a frame; at least one crusher rotor arranged rotatably to the frame, including crusher blades secured to the circumference thereof and crushing the material; a yielding counterblade structure arranged for co-operation with the crusher blades of the crusher rotor to concurrently crush and cut said material, the counterblade structure being arranged to yield when encountering non-crushable material and when overloaded; and a yielding, downwardly openable set of screens that is arranged below the crusher rotor at a selected axial distance from the crusher blades of the crusher rotor.

On the basis of the running rate the crushers may be divided into two categories: fast and slow running crushers. Fast running crushers are efficient, but they require a feed free from impurities, because, due to a high circumferential speed of the crusher rotor, their structures cannot be protected by automatically released safety means. Additional drawbacks include, inter alia, a fire risk, noise and harmful dust.

Slow running crushers are considerably better suited for crushing various fuel chips, but, due to a slow circumferential speed of the crusher rotor, they are often relatively limited in capacity. Whereas a rise in the circumferential speed implies an increased risk of crusher damage, and this has been tried to prevent by structures whose counterblades give way, when foreign, hard objects or pieces, typically of metal, are caught between the blade and the counterblade.

By using screen meshes surrounding the lower side of the crusher rotor it is possible to better achieve the desired piece size, and it may be possible to avoid construction of a separate screening system that requires large investments.

Known are crusher solutions that include a yielding counterblade, i.e. one that evades a foreign object, or, both a yielding counterblade and a separately openable set of screens. These solutions are complex to implement and they require specific control circuits which have to be controllable in such a manner that they operate synchronously, or one is to confine to manual use only.

Also known are structures where a set of screens and a counterblade are solidly connected, but they are linked to operate on the same side of the crusher rotor, which makes it difficult to remove a foreign object as well as to replace a screen mesh.

Publication US 2011259985 A1 discloses a crusher, in which interconnected counterblade and a set of screens may be collapsed down together to a maintenance position, but neither one of these evades an obstacle jointly or separately.

Publication EP 2113305 A2 describes a crusher, in which a counterblade and a set of screens may both give way separately, but they are mounted on bearings on different sides of the rotor.

Publication DE 102006050051 A1 discloses a crusher, in which counterblades are immovably connected to screen parts, one of which may yield. The counterblades are thus not capable of yielding independently.

In the crusher according to publication U.S. Pat. No. 7,222,805 B1 there are no separate counterblades, but grinding or crushing is performed against a fixed counterpart preceding a set of screens, and against the actual set of screens, which in turn may yield downwardly.

Publication U.S. Pat. No. 5,213,273 A discloses a crusher comprising two assemblies of screens/counterblades (i.e. the screen set is simultaneously a "counterblade"), which yield separately around bearing points locating on different sides of the crusher. Because the set of screens itself serves as a counterblade, there is no independently yielding counterblade.

Publication U.S. Pat. No. 4,917,310 A describes a crusher having a plurality of separate, yielding counterblade configurations (without an actual screens structure) that yield separately about various axes but not as one whole in any circumstances.

Publication EP 0254173 discloses a crusher, in which, below a crusher rotor, there is a structure consisting of two superimposed "screen system sections" where both screen systems may be collapsed together or separately about an axis situating on the opposite side of the rotor with respect to the feeding point of material to be crushed. Said screens structure also forms the actual "counterblade structure" and it does not yield downwardly by itself in any circumstances, because the screens are locked into place with bolts that have to be unlocked before the screens are collapsed down. The presented hydraulic cylinders only assist in moving the screens. The rotation rate of the screens is high and major part of the material to be screened exits through the screens above the rotor.

SUMMARY OF THE INVENTION

The object of the invention is to eliminate the drawbacks of the known solutions. This is achieved by a crusher of the invention, which is characterized in that a counterblade structure is linked to the frame of a set of screens and made turnable towards it in a yield situation about a pivoting shaft; and that the set of screens is linked to the crusher frame, on the opposite side of the crusher rotor with respect to the counterblade structure and its pivoting shaft, to be downwardly collapsible about the pivoting shaft of the set of screens.

The invention is based on the idea that the crusher has no separate frame structures for the counterblade structure and for the set of screens, but they are linked together in such a manner that they move in one package, providing, however, a separate evasive movement of protection. The same structure allows a possibility of easily removing foreign objects caught between the crusher rotor and the set of screens and a practical way of replacing a screen mesh. At the same time the structure is lighter, easier to implement and considerably simpler to control.

The basic idea of the invention is that even though the evasive counterblade structure is linked together with the set of screens, the counterblade structure is capable of performing an independent evasive movement. Thanks to the lighter structure and the vicinity of the pivoting point, the operation of an independent counterblade structure enables a considerably faster evasive movement and thus it protects better the blades of the crusher rotor and the counterblade structure itself.

Most preferably, the whole consisting of the set of screens and the counterblade structure is further supported to a common yielding structure, one end of which yielding structure is supported to the crusher frame and the other end to the counterblade structure between its free end and pivoting point.

LIST OF FIGURES

Figure 2:
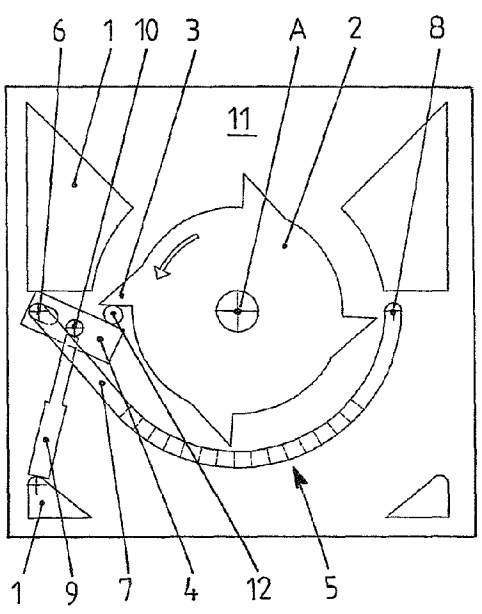
Figure 1:
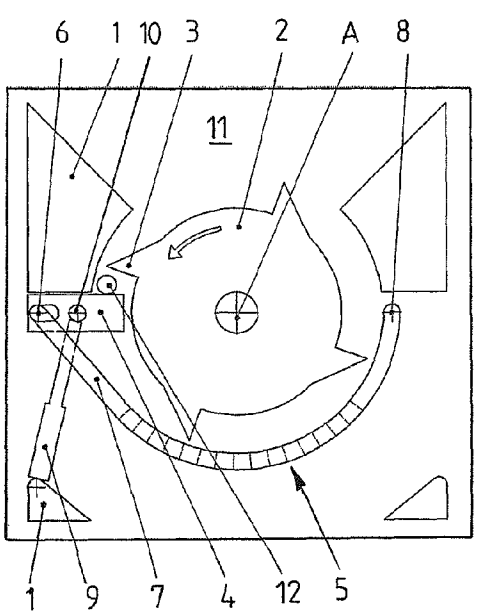

The invention will now be described in more detail by means of one preferred exemplary embodiment, with reference to the attached drawings, in which FIG. 1 shows a crusher of the invention in a normal crushing situation, seen in the axial direction of its crusher rotor;

FIG. 2 shows the crusher of the invention as in FIG. 1, but in a situation where the counterblade structure yields and FIG. 3 shows the crusher of the invention as in FIGS. 1 and 2, but in yielding and opening situations of both the counterblade structure and the set of screens.

DETAILED DESCRIPTION OF THE INVENTION

With reference to the drawings, the crusher of the invention for crushing solid material comprises a frame 1; at least one crusher rotor 2 arranged rotatably about an axis A to the frame 1, including crusher blades 3 secured to the circumference thereof and crushing the material; a yielding counterblade structure 4 arranged for cooperation with the crusher blades 3 of the crusher rotor 2; and a yielding, downwardly openable set of screens 5 that is arranged below the crusher rotor 2 at a selected axial distance from the crusher blades 3 of the crusher rotor 2.

The counterblade structure 4 is linked with a pivoting shaft 6 to the frame 7 of the set of screens 5 and made turnable towards it in a yield situation with respect to the pivoting shaft 6, and the set of screens 5, in turn, is linked with a pivoting shaft 8 to the crusher frame 1, on the opposite side of the crusher rotor 2 with respect to the counterblade structure 4 and its pivoting shaft 6 and to be downwardly collapsible about said pivoting shaft 8.

In this exemplary implementation the whole consisting of the set of screens 5 and the counterblade structure 4 is further supported to a common yielding structure 9, the lower end of which yielding structure 9 is supported to the crusher frame 1 and the upper end is supported to the counterblade structure 4 between its free end and pivoting shaft 6 with a pivoting shaft 10 of the yielding structure 9. For instance one or more hydraulic cylinders or pneumatic or mechanical springs may serve as the yielding structure 9. If there are several separate yielding members, such as said hydraulic cylinders, they are located with even spacing in the longitudinal direction of the counterblade structure 4 and the set of screens 5 (in the axial direction of the crusher rotor 2). In that case the counterblade structure 4 itself may also be divided into a plurality of portions in the axial direction of the crusher rotor 2. If so desired, it is naturally possible to arrange separate yielding structures for the counterblade structure 4 and for the set of screens 5, but, in practice, a structure common to both is most preferable and its control is easiest to arrange.

When the crusher is used as shown in FIG. 1, material to be crushed is conveyed, through an open feeding funnel 11 in the upper part of the crusher, between the crusher blades 3 of the crusher rotor 2 and the counterblade structure 4, which together crush and cut the material to be fed into a desired piece size. As shown in FIG. 2, when a hard object 12 (e.g. a large piece of metal) is caught between the crusher blades 3 and the counterblade structure 4 (or a portion thereof), the counterblade structure 4 (or a portion thereof) yields about its pivoting shaft 6 by means of the yielding structure 9 and prevents said cooperating crushing members 3 and 4 from being damaged. In a further situation, as shown in FIG. 3, the set of screens 5 integrated in the counterblade structure 4 may start opening about its pivoting shaft 8, and if necessary, it may be controlled to stop the crusher rotor 2, which enables removal of the foreign object 12 caught between the set of screens 5 and the crusher rotor 2 via an open jaw 13 provided.

The above description of the invention is only intended to illustrate the basic idea of the invention. A person skilled in the art may, however, implement the details of the invention in various ways within the scope of the attached claims.

The invention claimed is:

1. A crusher for crushing solid material, the crusher comprising:

a crusher frame (1);

at least one crusher rotor (2) arranged rotatably to the crusher frame (1), the crusher rotor having a circumference and having a plurality of crusher blades (3) secured to the circumference for crushing the material;

a yielding counterblade structure (4) arranged for cooperation with the crusher blades (3) of the crusher rotor (2) to concurrently crush and cut the material, the counterblade structure (4) being arranged to yield in a situation wherein the counterblade structure (4) encounters non-crushable material (12) and is overloaded;

a yielding, downwardly openable set of screens (5) that is arranged below the crusher rotor (2) at a selected axial distance from the crusher blades (3) of the crusher rotor (2), and a frame (7) for the set of screens, wherein the counterblade structure (4) is linked to the frame (7) for the set of screens (5) at a first pivoting shaft (6) and is turnable about the first pivoting shaft (6) towards the frame for the set of screens (5) in the yield situation; and wherein the set of screens (5) is linked to the crusher frame (1) at a second pivoting shaft (8) on an opposite side of the crusher rotor (2) to the counterblade structure (4) and the first pivoting shaft (6) and the set of screens (5) is downwardly collapsible about the second pivoting shaft (8), and wherein the counterblade structure is rotatable about a third pivoting shaft (10) that is movable relative to the crusher frame.

2. The crusher of claim 1, wherein the set of screens (5) and the counterblade structure (4) are supported on a common yielding structure (9) having a first end and a second end, the first end of the yielding structure being supported on the crusher frame (1) and the second end of the yielding structure comprising the third pivoting shaft (10) supporting the counterblade structure (4) between a free end of the counterblade structure (4) and the first pivoting shaft (6).

3. The crusher of claim 2, wherein the counterblade structure (4) is divided into a plurality of portions in the axial direction of the crusher rotor (2).

4. The crusher of claim 2, wherein the counterblade structure (4) is movable from a first position adjacent to the crusher frame to a second position that is spaced from the crusher frame so as to define an open jaw between the crusher frame and the counterblade structure.

5. The crusher of claim 2, wherein the yielding structure (9) comprises at least one hydraulic cylinder.

6. The crusher of claim 5, wherein the counterblade structure (4) is divided into a plurality of portions in the axial direction of the crusher rotor (2).

7. The crusher of claim 2, wherein the yielding structure (9) comprises at least one pneumatic or mechanical spring.

8. The crusher of claim 7, wherein the counterblade structure (4) is divided into a plurality of portions in the axial direction of the crusher rotor (2).

9. The crusher of claim 1, wherein the counterblade structure (4) is divided into a plurality of portions in an axial direction of the crusher rotor (2).

10. The crusher of claim 9, wherein the yielding structure (9) comprises at least one hydraulic cylinder.

11. The crusher of claim 9, wherein the yielding structure (9) comprises at least one pneumatic or mechanical spring.

12. The crusher of claim 1, wherein the counterblade structure (4) is movable from a first position adjacent to the crusher frame to a second position that is spaced from the crusher frame so as to define an open jaw between the crusher frame and the counterblade structure.

* * * * *